US008715553B2

(12) United States Patent
Barlag et al.

(10) Patent No.: US 8,715,553 B2
(45) Date of Patent: May 6, 2014

(54) METHOD AND DEVICE FOR TREATING A SURFACE OF A FIBRE COMPOSITE MATERIAL

(75) Inventors: Carsten Barlag, Jever (DE); Timo Stoeven, Bremen (DE)

(73) Assignee: Airbus Operations GmbH, Hamburg (DE)

( * ) Notice: Subject to any disclaimer, the term of this patent is extended or adjusted under 35 U.S.C. 154(b) by 0 days.

(21) Appl. No.: 12/940,471

(22) Filed: Nov. 5, 2010

(65) Prior Publication Data

US 2011/0133358 A1 Jun. 9, 2011

Related U.S. Application Data

(63) Continuation of application No. PCT/EP2009/055569, filed on May 7, 2009.

(30) Foreign Application Priority Data

May 7, 2008 (DE) ..... 10 2008 022 649

(51) Int. Cl.
*B28B 11/08* (2006.01)

(52) U.S. Cl.
USPC ..... 264/162

(58) Field of Classification Search
USPC ..... 264/138, 162
See application file for complete search history.

(56) References Cited

U.S. PATENT DOCUMENTS

| | | | | |
|---|---|---|---|---|
| 3,908,314 A | | 9/1975 | Watanabe et al. | |
| 4,545,155 A | | 10/1985 | Nakata | |
| 4,731,125 A | | 3/1988 | Carr | |
| 4,832,706 A | | 5/1989 | Yates | |
| 5,261,191 A | * | 11/1993 | Wick | 451/39 |
| 2005/0130565 A1 | * | 6/2005 | Oellerich | 451/38 |
| 2006/0267397 A1 | * | 11/2006 | Possarnig et al. | 301/95.102 |

FOREIGN PATENT DOCUMENTS

| | | |
|---|---|---|
| AT | 69574 | 8/1915 |
| AU | 5756180 | 10/1981 |
| AU | 539670 B2 | 10/1984 |
| DE | 10302594 | 7/2004 |
| DE | 10 2008 022649 | 11/2009 |
| EP | 0282587 B1 | 9/1988 |
| EP | 2 303 511 | 2/2012 |
| RU | 2002601 | 11/1993 |
| WO | WO 88/02299 | 4/1988 |
| WO | WO 90/11163 | 10/1990 |

OTHER PUBLICATIONS

International Search Report for PCT/EP2009/055569 dated Aug. 18, 2009.

(Continued)

*Primary Examiner* — Yogendra Gupta
*Assistant Examiner* — Robert J Grun
(74) *Attorney, Agent, or Firm* — Jenkins, Wilson, Taylor & Hunt, P.A.

(57) ABSTRACT

The present invention provides a method and a device for treating a surface of a fiber composite material which contains fibers of a specific hardness, the surface of the fiber composite material being removed abrasively by an abrasion means, the hardness of which is less than the hardness of the fibers contained in the fiber composite material and is greater than the hardness of a plastics material in which the fibers of the fiber composite material are embedded.

12 Claims, 3 Drawing Sheets

(56) References Cited

OTHER PUBLICATIONS

Chinese Office Action for Application Serial CN 200980116537.1 dated May 15, 2012.

Russian Decision to Grant for Application No. 2010145223/02 dated Apr. 10, 2013.

European Decision to Grant for Application No. 09742140.8 dated Jan. 5, 2012.

* cited by examiner

METHOD AND DEVICE FOR TREATING A SURFACE OF A FIBRE COMPOSITE MATERIAL

CROSS-REFERENCE TO RELATED APPLICATIONS

This application is a continuation of PCT/EP2009/055569 filed May 7, 2009 and claims the benefit of German Patent Application No. 10 2008 022 649.1, filed May 7, 2008, the entire disclosures of which are herein incorporated by reference.

FIELD OF THE INVENTION

The invention relates to a method and a device for treating a surface of a fibre composite material, in particular a carbon fibre reinforced plastics material (CFRP).

In aircraft construction, fibre composite materials are used to an increasing extent. Fibre composite materials are materials which are reinforced by embedded fibres. Glass fibre reinforced plastics materials (GFRP), carbon fibre reinforced plastics materials (CFRP) and aramid fibre reinforced plastics materials (aramid fibre composite, AFC) are used most frequently.

The surfaces of carbon fibre reinforced plastics materials have to be treated when components are to be adhesively bonded onto such fibre composite materials. For example, adhered surfaces of the upper and lower shells of aerofoils must be carefully pre-treated before they are bonded together to form a finished wing.

The parts of the aircraft exposed to extreme loads during flight operation must not fail. Adhesive joints which have a lower strength than the basic material can give rise to a weakening of a structural part.

To avoid such weak points, the surfaces provided for further processing by adhesive bonding are conventionally initially ground. When laminated raw surfaces are ground, there is the danger that the fibres which determine the strength will be damaged by the grinding process.

FIG. 1A, 1B schematically show a surface treatment of a fibre composite material in which the fibre composite material is ground in the conventional manner.

As shown in FIG. 1A, fibres F1, F2 are embedded in a plastics material K of the fibre composite material in order to make the material stronger. The fibres F of the composite material have a relatively high hardness and are relatively brittle. As can be seen in FIG. 1, the fibres F which are embedded in the plastics material K of the composite material have a certain undulation. As shown in FIG. 1A, 1B, when the surface of the composite material is ground, some of the fibres embedded therein, for example the fibres F1 shown in FIG. 1A, 1B, can be severed. The severing of one or more fibres reduces the strength of the composite material.

Thus, when the surface of a fibre composite material is ground, there is the danger that the strength-determining fibres will be damaged or severed by the grinding process. This can be established by measurement of the surface resistance, since the fibres are usually electrically conductive.

Therefore, a method was proposed in DE 103 025 94 A1 for preparing surfaces made of carbon fibre reinforced plastics materials for the further processing of load-bearing structural parts, in which method the surface of the carbon fibre reinforced plastics material is treated with an abrasive which uses sharp-edged corundum grain.

However, this known method suffers from the disadvantage that, during the surface treatment of the composite material, the corundum grains not only remove the plastics material, but also act on the brittle fibres which are exposed during this procedure. This known conventional method can thus also result in the severing of fibres of the composite material.

SUMMARY OF THE INVENTION

Therefore, an object of the present invention is to provide a method and a device for treating a surface of a fibre composite material, with which the strength of the fibre composite material is not impaired.

This object is achieved according to the invention by a method which has the features stated in claim 1.

The invention provides a method for treating a surface of a fibre composite material which contains fibres of a specific hardness, the surface of the fibre composite material being removed by an abrasion means, the hardness of which is less than the hardness of the fibres contained in the fibre composite material and is greater than the hardness of a plastics material in which the fibres of the fibre composite material are embedded.

In an embodiment of the method according to the invention, the abrasion means is blasted onto the surface of the fibre composite material by means of a gaseous fluid. In an embodiment of the method according to the invention, the abrasion means is blasted onto the surface of the fibre composite material by means of a liquid fluid.

In a possible embodiment of the method according to the invention, the gaseous fluid is formed by air.

In a possible embodiment of the method according to the invention, the liquid fluid is formed by water.

In a further embodiment of the method according to the invention, the abrasion means is cast centrifugally onto the surface of the fibre composite material.

In a possible embodiment of the method according to the invention, the abrasion means is formed by urea resin.

In a possible embodiment of the method according to the invention, the hardness of the abrasion means is from 3 to 4 Mohs.

In the method according to the invention, the surface of the fibre composite material is preferably prepared for adhesive bonding.

In a possible embodiment of the method according to the invention, the grains of the abrasion means have a size of from 0.10 to 1.80 mm.

In a possible embodiment of the method according to the invention, the grains of the abrasion means have a size of from 0.10 to 0.50 mm.

In a possible embodiment of the method according to the invention, the fibre composite material is a carbon fibre reinforced plastics material.

In a possible embodiment of the method according to the invention, the fibre composite material is a glass fibre reinforced plastics material.

In an embodiment of the method according to the invention, the treated surface is blown with compressed air to remove the abrasion means which was used.

In an embodiment of the method according to the invention, an adhesive is applied to the treated surface of the fibre composite material and thereafter a component is pressed on.

The invention further provides an abrasion means for treating a surface of a fibre composite material which contains fibres of a specific hardness, the abrasion means removing the surface of the fibre composite material in an abrasive manner and having a hardness which is less than the hardness of the fibres contained in the fibre composite material and is greater than the hardness of a plastics material in which the fibres of the fibre composite material are embedded.

In a possible embodiment of the abrasion means according to the invention, the abrasion means comprises urea resin.

In a possible embodiment of the abrasion means according to the invention, the abrasion means consists of grains which have sharp-edged and irregular grain shapes.

In a possible embodiment of the abrasion means according to the invention, the grains of the abrasion means have a grain size of from 0.10 to 1.80 mm.

In an embodiment of the abrasion means according to the invention, the grains of the abrasion means have a grain size of from 0.10 to 0.50 mm.

In a possible embodiment of the abrasion means according to the invention, the abrasion means has a hardness of between 3 and 4 Mohs.

The invention further provides a device for treating a surface of a fibre composite material having the features disclosed herein.

The invention provides a device for treating a surface of a fibre composite material which contains fibres of a specific hardness, an abrasion means being directed onto the surface, said abrasion means having a hardness which is less than the hardness of the fibres contained in the fibre composite material and is greater than the hardness of a plastics material in which the fibres of the fibre composite material are embedded.

In an embodiment of the device according to the invention, the abrasion means is blasted by a blasting means onto the surface of the fibre composite material by means of a pressurised gaseous or liquid fluid.

In an alternative embodiment of the device according to the invention, the abrasion means is cast centrifugally onto the surface of the fibre composite material by a centrifugation means.

In an embodiment of the device according to the invention, the abrasion means abrasively strips a surface layer of the fibre composite material down to an adjustable depth, without damaging fibres contained in the fibre composite material.

In the following, embodiments of the method and the device according to the invention for treating a surface of a fibre composite material are described with reference to the accompanying figures.

DESCRIPTION OF EXEMPLARY EMBODIMENTS

Figure 1A:
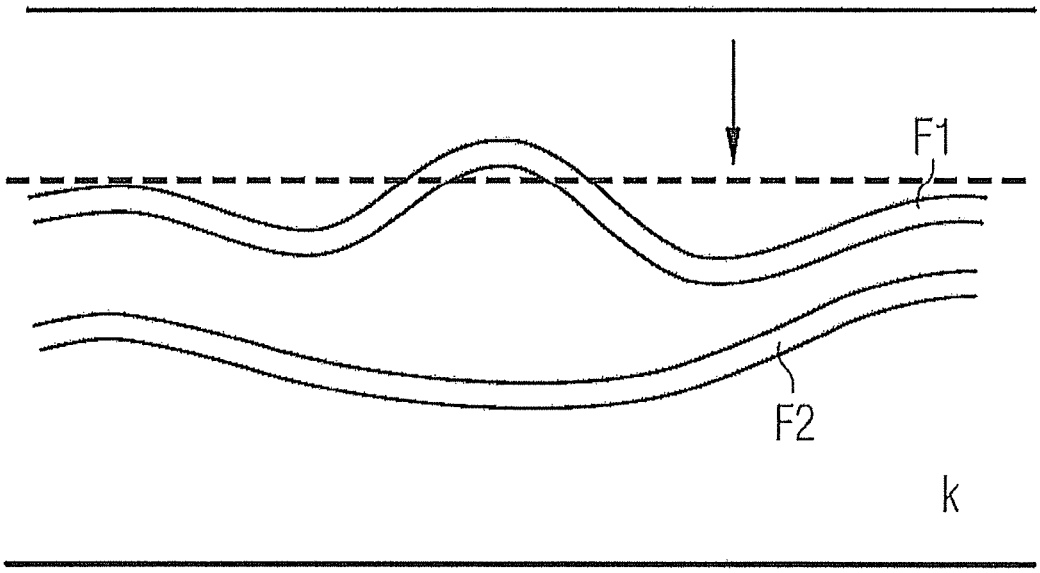
FIG1A Prior art
FIG. 1A, 1B are sectional views through a fibre composite material to illustrate a known conventional grinding procedure for treating the surface of the fibre composite material.
Figure 1B:
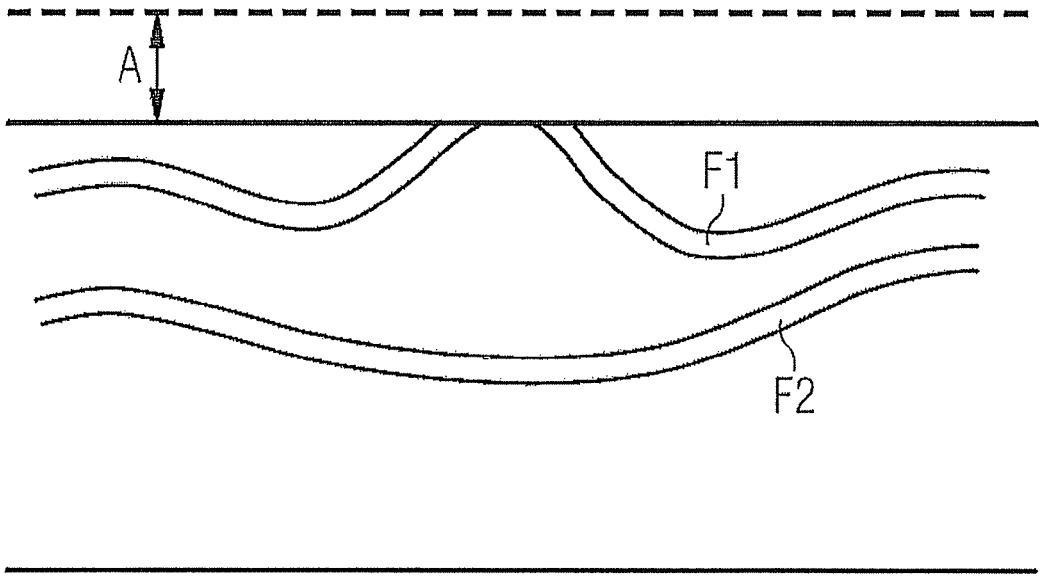
FIG 1B Prior art
Figure 2A:
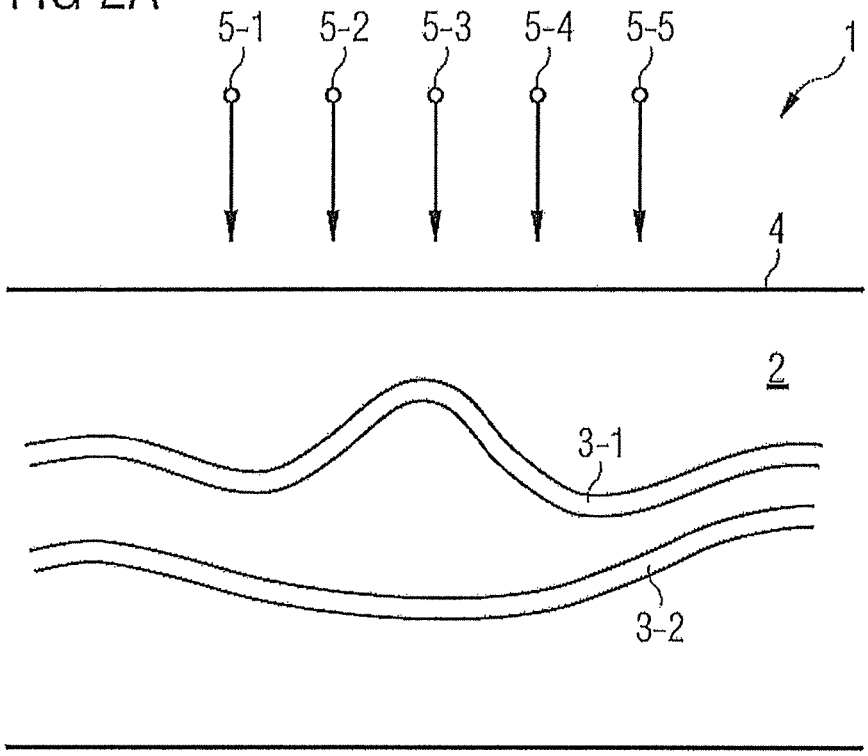
FIG. 2A, 2B are sectional views through a fibre composite material to explain the method according to the invention.

As can be seen in FIG. 2A, a fibre composite material 1 to be treated by the method of the invention consists of a plastics material 2 in which fibres 3-1, 3-2 are embedded. The fibres 3-1, 3-2 are high-strength fibres which impart strength to the composite material. The fibres 3-1, 3-2 can be, for example, carbon fibres, said fibres being impregnated in resin, for example. The plastics material 2 or the resin can be, for example, a duromer. In the case of a fibre composite material with a polymer matrix, the fibres are impregnated with the resin. This is either performed in layers, i.e. alternately resin matting and fibre matting to produce a laminated composite or by prepregs which are cut to size and cured in moulds at elevated temperature and under elevated pressure to produce components. The characteristics of the fibre composite material 1 can vary due to the differing orientation of the fibres 3-*i*. The fibre composite material 1 shown in FIG. 2A can also be a glass fibre reinforced plastics material GFRP or an aramid fibre reinforced plastics material AFC. The plastics material 2 in which the fibres 3-*i* are embedded has a specific hardness $H_K$. The fibres 3-*i* embedded in the plastics material 2 also have a predetermined hardness $H_F$.

Figure 2B:
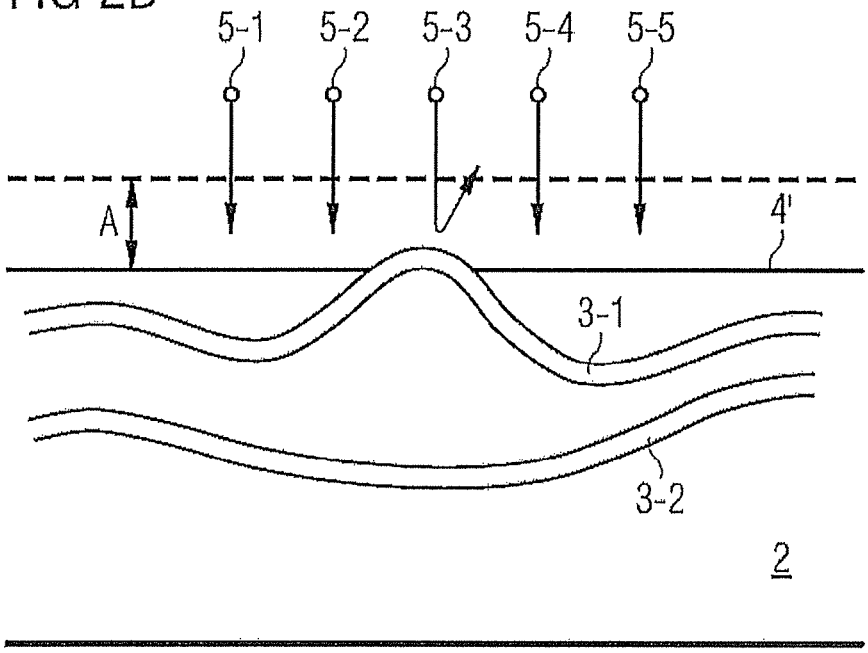

In the method according to the invention, as shown schematically in FIG. 2A, an abrasion means 5 is blasted or cast centrifugally onto a surface 4 of the fibre composite material 1. This abrasion means 5 contains a large number of grains 5-1 to 5-5. The impact of the grains 5-*i* on the surface 4 of the fibre composite material 1 causes an abrasive stripping of the surface 4, since the abrasion means 5 or the grains 5-*i* of the abrasion means 5 have a hardness $H_A$ which is greater than the hardness $H_K$ of the plastics material 2 in which the fibres 3-*i* of the fibre composite material 1 are embedded. As shown in FIG. 2A, 2B, the surface is abrasively removed by the abrasion means 5 starting from the original surface 4 of the fibre composite material 1 down to the surface 4' of the fibre composite material 1. As soon as grains of the abrasion means 5 meet a fibre 3-*i* which is embedded in the plastics material 2, they rebound off the fibre 3-*i*, as shown in FIG. 2B. As can be seen in FIG. 2B, the grain 5-3 of the abrasion means 5 impacts an exposed fibre 3-*i* which is embedded in the plastics material 2.

Figure 3:
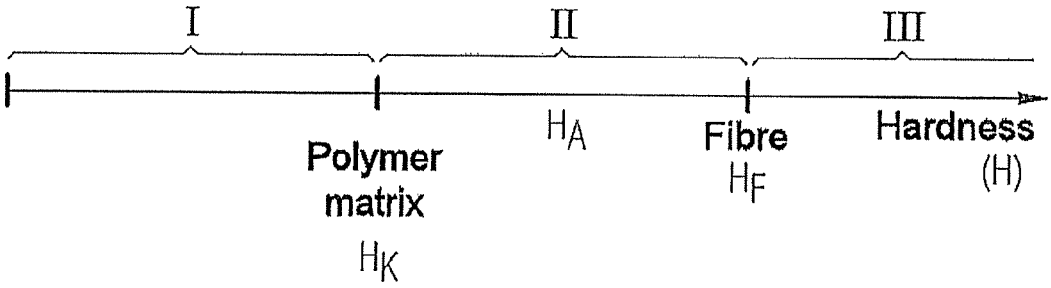
FIG. 3 is a diagram to explain the method according to the invention.

In the method according to the invention, an abrasion means 5 is used, the hardness $H_A$ of which is less than the hardness $H_F$ of the fibres 3-*i* contained in the fibre composite material 1. At the same time, the abrasion means 5 has a hardness $H_A$ which is greater than the hardness $H_K$ of the plastics material 2 in which the fibres 3-*i* of the fibre composite material 1 are embedded. This is illustrated in the diagram according to FIG. 3. The hardness $H_A$ of the abrasion means 5 is within a range between the hardness $H_K$ of the polymer matrix and the hardness $H_F$ of the fibres 3:

$$H_K<H_A<H_F$$

In an embodiment, the hardness $H_A$ of the abrasion means 5 is in a range of from 3 to 4 Mohs.

After a specific amount of fibre composite material 1 has been removed from the surface thereof, for example a layer of a plurality of micrometers, the surface 4' of the fibre composite material 1 which has formed is ready for further production steps, for example for adhesive bonding of a component.

Figure 4:
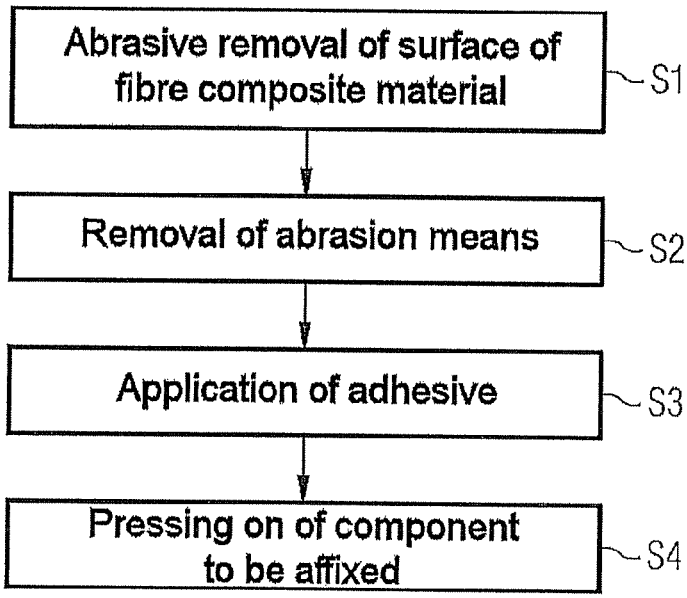
FIG. 4 is a flow chart to illustrate fundamental method steps for adhesively bonding a component onto a fibre composite material.

FIG. 4 shows production steps which use the method according to the invention for treating a surface of a fibre composite material 1.

Firstly, in a step S1, the original surface 4 of the fibre composite material 1 is abrasively removed using an abrasion means 5, the hardness $H_A$ of which is less than the hardness $H_F$ of the fibres 3 contained in the fibre composite material 1 and is greater than the hardness $H_K$ of a plastics material 2 in which the fibres 3 of the fibre composite material 1 are embedded. In this respect, the fibres 3 are, for example, carbon fibres.

Alternatively, the fibres 3 can also be glass fibres of a specific hardness. It is also possible for the fibres to be aramid fibres of a specific hardness. The hardness $H_A$ of the abrasion means 5 used is thus selected as a function of the predetermined hardness $H_F$ of the fibres 3 embedded in the plastics material 2. Furthermore, the hardness $H_A$ of the abrasion means 5 is selected as a function of the predetermined hardness $H_K$ of the plastics material 2.

In a possible embodiment, the depth or extent of the removal A, as shown in FIG. 2B, can be adjusted. As soon as the abrasive removal in step S1 is finished, in a step S2 the treated surface 4' of the fibre composite material 1 is blown with compressed air to remove the abrasion means. In a further step S3, adhesive, for example, is applied to the surface 4' of the fibre composite material 1 from which the abrasion means has been removed.

In a further step S4, a component to be affixed is pressed onto the treated surface 4' which has been coated with adhesive, and this can be carried out at an elevated temperature.

In a possible embodiment of the method according to the invention, the abrasion means 5 is formed by urea resin, the grain size of the grains 5-*i* of the abrasion means 5 being in a range of from 0.10 to 1.80 mm, preferably in a range of from 0.10 to 0.50 mm.

In step S1, the abrasion means 5 can be blasted onto the surface 4 of the fibre composite material 1 by means of a gaseous fluid. This gaseous fluid is, for example, air.

Alternatively, the abrasion means 5 can be blasted onto the surface 4 of the fibre composite material 1 by means of a liquid fluid. This liquid fluid can be, for example, water.

In a further variant, the abrasion means 5 is cast centrifugally onto the surface of the fibre composite material 1 by a centrifugation means.

The method shown in FIG. 4 can be carried out by a production device which comprises a device for treating a surface of a fibre composite material 1. This device for treating a surface 4 of a fibre composite material 1 comprises a unit which directs or blasts an abrasion means 5 onto the surface 4 of the fibre composite material 1, the hardness $H_A$ of said abrasion means being less than the hardness $H_F$ of the fibres 3 contained in the fibre composite material 1 and being greater than the hardness $H_K$ of a plastics material 2 in which the fibres 3 of the fibre composite material 1 are embedded.

In a possible embodiment, the abrasion means 5 is located in a reservoir or container of the surface treatment device.

In a variant of the surface treatment device according to the invention, said surface treatment device contains a blasting means which blasts the abrasion means 5 onto the surface 4 of the fibre composite material 1 by means of a pressurised fluid. In this respect, the pressure can preferably be adjusted. The fluid can be a gaseous or liquid fluid which is located in a container of the surface treatment device.

In an alternative embodiment, the treatment device comprises a centrifugation means which centrifugally casts the abrasion means 5 onto the surface 4 of the fibre composite material 1.

The surface treatment device abrasively removes a degraded surface layer of the fibre composite material 1 down to an adjustable depth without damaging the fibres 3 contained in the fibre composite material 1, since the hardness $H_A$ of the abrasion means 5 used is less than the hardness $H_F$ of the fibres 3 embedded in the fibre composite material 1.

The invention claimed is:

1. A method for treating a surface of a fibre composite material which contains fibres of a specific hardness, wherein the surface of the fibre composite material is removed abrasively by an abrasion means, the hardness of which is less than the hardness of the fibres contained in the fibre composite material and is greater than the hardness of a plastics material in which the fibres of the fibre composite material are embedded, and wherein fibres contained in the fibre composite material are exposed, without being damaged when met by the abrasion means which rebounds off the exposed fibres.

2. The method according to claim 1, wherein the abrasion means is blasted onto the surface of the fibre composite material by means of a gaseous or liquid fluid.

3. The method according to claim 2, wherein the fluid is formed by air or water.

4. The method according to claim 1, wherein the abrasion means is cast centrifugally onto the surface of the fibre composite material.

5. The method according to claim 1, wherein the abrasion means is formed by urea resin.

6. The method according to claim 1, wherein the hardness of the abrasion means is from three to four Mohs.

7. The method according to claim 1, wherein the surface of the fibre composite material is prepared for adhesive bonding or painting.

8. The method according to claim 1, wherein grains of the abrasion means have a grain size of from 0.10 to 1.80 mm.

9. The method according to claim 8, wherein the grains of the abrasion means have a grain size of from 0.10 to 0.50 mm.

10. The method according to claim 1, wherein the fibre composite material is a carbon fibre-reinforced plastics material or a glass fibre-reinforced plastics material.

11. The method according to claim 1, wherein the treated surface of the fibre composite material is blown with compressed air to remove the abrasion means.

12. The method according to claim 11, wherein an adhesive is applied to the treated surface of the fibre composite material and a component is pressed onto the treated surface.

* * * * *